US007351317B2

(12) United States Patent
Dulle et al.

(10) Patent No.: US 7,351,317 B2
(45) Date of Patent: Apr. 1, 2008

(54) ELECTROLYTIC CELL COMPRISING AN INTERIOR TROUGH

(75) Inventors: Karl Heinz Dulle, Olfen (DE); Peter Woltering, Neuenkirchen (DE); Frank Funck, Mülheim (DE); Martin Wollny, Witten (DE); Randolf Kiefer, Bochum (DE); Thomas Steinmetz, Dortmund (DE); Kosmas Janowitz, Dortmund (DE); Roland Beckmann, Lünen (DE); Torsten Dresel, Hagen (DE); Hans-Joachim Hartz, Unna (DE)

(73) Assignee: Uhdenora Technologies S.r.l., Milan (IT)

( * ) Notice: Subject to any disclaimer, the term of this patent is extended or adjusted under 35 U.S.C. 154(b) by 342 days.

(21) Appl. No.: 10/531,863

(22) PCT Filed: Oct. 16, 2003

(86) PCT No.: PCT/DE03/03431

§ 371 (c)(1),
(2), (4) Date: May 25, 2005

(87) PCT Pub. No.: WO2004/040040

PCT Pub. Date: May 13, 2004

(65) Prior Publication Data

US 2006/0006062 A1 Jan. 12, 2006

(30) Foreign Application Priority Data

Oct. 23, 2002 (DE) ..... 102 49 508

(51) Int. Cl.
*C25B 9/08* (2006.01)

(52) U.S. Cl. ..... 204/266; 204/263; 204/252; 204/253; 204/254; 204/257; 204/258

(58) Field of Classification Search ..... 204/254, 204/268, 257, 258, 269, 270, 266, 278, 263, 204/252, 253, 255, 256
See application file for complete search history.

(56) References Cited

U.S. PATENT DOCUMENTS 4,839,012 A 6/1989 Burney, Jr. et al.

(Continued)

FOREIGN PATENT DOCUMENTS

DE 197 40 673 A 3/1999

*Primary Examiner*—Bruce F. Bell
(74) *Attorney, Agent, or Firm*—Charles A. Muserlian

(57) ABSTRACT

The invention relates to an electrolysis device for halogen gas production from an aqueous alkali halide solution in several plate-type electrolysis cells stacked and arranged side by side, with electrical contacts, each of the cells with a housing consisting of two half-shells made of electrically conductive material, said housing being equipped with devices for feeding electrolytic current and the electrolysis plant reactants and devices for discharging electrolytic current and discharging the electrolysis products, with anodic electrode, cathodic electrode and a membrane arranged therebetween, built-in components being fitted in at least one of the two half-shells and permitting a defined increase in the liquid level and thus minimizing the remaining gas volume accordingly.

The built-in components are arranged in such a manner that they form an internal trough parallel to the said membrane and arranged horizontally, an interspace thus being provided between the trough and the membrane and an interspace between the trough and the electrolysis chamber, a part of which is located above the membrane, said trough having at least one opening communicating with the interspace between said trough and the upper side of the electrolytic chamber, and at least one outlet.

10 Claims, 1 Drawing Sheet

U.S. PATENT DOCUMENTS 5,194,132 A 3/1993 Hartmann et al.
6,214,181 B1 * 4/2001 Iacopetti et al. ..... 204/256
6,503,377 B1 * 1/2003 Borucinski et al. ..... 204/257

* cited by examiner

ELECTROLYTIC CELL COMPRISING AN INTERIOR TROUGH

This application is a 371 OF PCT/DE2003/003431 field Oct. 16, 2003.

The invention relates to an electrolytic device for halogen gas production from aqueous alkali halide solution in several plate-type electrolytic cells stacked and arranged side-by-side and provided with electrical contacts, each of the cells provided with a housing consisting of two half-shells made of electrically conductive material and having external contact strips on at least one housing rear wall, said housing being equipped with devices for feeding electrolytic current and electrolysis reactants and for discharging electrolytic current and products, with anodic and cathodic electrodes that evolve gas during normal operation and with gas outlets.

STATE OF THE ART

Electrolytic cells are well known and a typical example of state-of-the-art technology is described in DE 196 41 125 A1. A device of this type ensures adequate gas separation in the upper rear zone by means of a guide plate arranged towards the membrane and which is in addition used for sufficiently wetting the electrolytic membrane during the electrolyser operation. However, difficulties in maintaining such a wetting may arise from interruptions of the electrolyser operation.

In order to protect the standard coatings it is possible to polarise the cell during downtime periods such as start-up, shut-down, service interruptions or failures. This applies whenever the cell must be filled and heated prior to starting operation. When shutting down the electrolyser it is likewise imperative that the polarisation be maintained until the anodic liquid is purged from chlorine and cooled down.

In case the electrolyser membrane is not sufficiently flooded in the upper cell zone, the single element technology as described in DE 195 41 125 A1 provides for a liquid level adjustment in the half-shells via the overfall weir of the standpipe. The polarisation current must not be selected arbitrarily but has to exceed a given threshold.

Depending on the type of material used for the standpipe, such as metal or PTFE, and on its chamfered angle, gas zones more than 20 mm high may be established in the upper part of the cell in the cold state. Investigations revealed that the membrane installed in the electrolytic cell is not gas-tight but presents a diffusion rate that depends on the molecular size, irrespective of the differential pressure between the anodic and cathodic chambers. As hydrogen gas is generated at the cathode and chlorine or oxygen gas are generated at the anode depending on the current density, hydrogen gas diffuses in the anodic chamber on account of its substantially smaller atomic size. The amount of the anodic gas build-up when the polarisation is switched on must be such that the explosion limit of the chlorine/hydrogen mixture or oxygen/hydrogen mixture is assuredly not reached. The production rate of oxygen or chlorine gas to be set is directly proportional to the polarisation current and also depends on the membrane surface area in the gas chamber. An electrolyser as described in DE 196 41 125 A1 requires a polarisation current of approx. 28 A, said device having PTFE standpipes and a gas chamber 20 mm high in the warm state and up to 30 mm high in the cold state of the electrolyser.

The object of the invention, therefore, is to design a device that overcomes the aforementioned difficulties and that requires lower polarisation currents.

The object of the invention is achieved by providing built-in components to be installed in the electrolyser in such a manner that the liquid level is raised so as to minimise the volume of the remaining gas zone and to reduce the minimum current required for polarisation. This method permits the filling of the cell element over the top edge of the membrane so that the minimum current required for polarisation with the element filled, hence in the absence of a hydrogen gas chamber contacting the electrolytic membrane, is achieved even by currentless polarisation.

The invention provides for built-in components to be installed in the appropriate electrolytic chamber and suited for playing a role in the hydraulics and dynamics of the liquid/gas mixture. Said built-in components are characterised in that

- they form an internal trough located in parallel to the electrolytic membrane and arranged horizontally,
- a first interspace is provided between the trough and the electrolytic membrane, and
- a second interspace is also formed between said trough and the upper side of the electrolytic chamber, said interspace at least in part located above the lowest point of the upper inner electrolyte chamber in the area of the membrane, wherein
- said trough has at least one opening communicating with the interspace between the trough and the upper side of the electrolytic chamber,
- said trough has at least one outlet.

It is possible to provide the internal trough either on the anodic or cathodic side or on both the anodic and cathodic sides and it serves as an overfall weir for liquid or gas. Moreover, it may be arranged along the whole cell width, merely in the inlet and outlet sections or in any other section therebetween.

OBJECTS OF THE INVENTION

In a particular embodiment of the invention, the interspace between the trough and the upper side of the electrolytic chamber is implemented as a gap, preferably of 2 to 3 mm width. In a particularly preferred embodiment such gap is inclined both outwards and upwards with respect to the horizontal plane as seen from the electrolytic membrane. The gap may also have a variable width, the adjacent interfaces being straight, corrugated or arched.

In a further embodiment of the invention, the interspace between the trough and the upper side of the electrolytic chamber is equipped with a perforated plate arranged parallel to the electrolytic membrane or slightly inclined therefrom so that the holes have the function of a perforated diaphragm.

According to a further embodiment of the invention, the interspace between the trough and the upper part of the electrolytic chamber is equipped with a duct bundle, the axes of the ducts lying in the plane of the interspace. The ducts need not be circular but may also be honeycomb-structured. The greater stiffness of this structure constitutes a particular advantage.

BRIEF SUMMARY OF THE INVENTION

A further embodiment of the invention provides for beads, webs, nipples or other spacers to be installed in the interspace between the trough and the upper part of the electrolytic chamber, said spacers being used to geometrically delimit said interspace and to secure the implementation of the defined flow pattern.

According to a further embodiment of the invention, the members which form the trough, inlets, outlets and related supports are at least partly coated to ensure corrosion protection.

A further advantage of the invention is that the lower part of the trough also assumes the function of gas pre-separation which calms down the flow and dampens or even prevents pulsation.

A leak of the trough will not necessarily jeopardise the operation of the electrolytic cell since the cell built-in components are sealed inside the cell, which represents a further advantage.

The device according to the invention can be retrofitted as an assembly into existing plants, which is a further advantage.

The device designed in accordance with the invention, moreover, has a particular advantage in that the anodic and cathodic rear walls need not specific geometric requirements, hence they may be straight, corrugated or inclined.

BRIEF DESCRIPTION OF THE DRAWING

In the following, the invention will be illustrated by means of an example.

Figure 1:
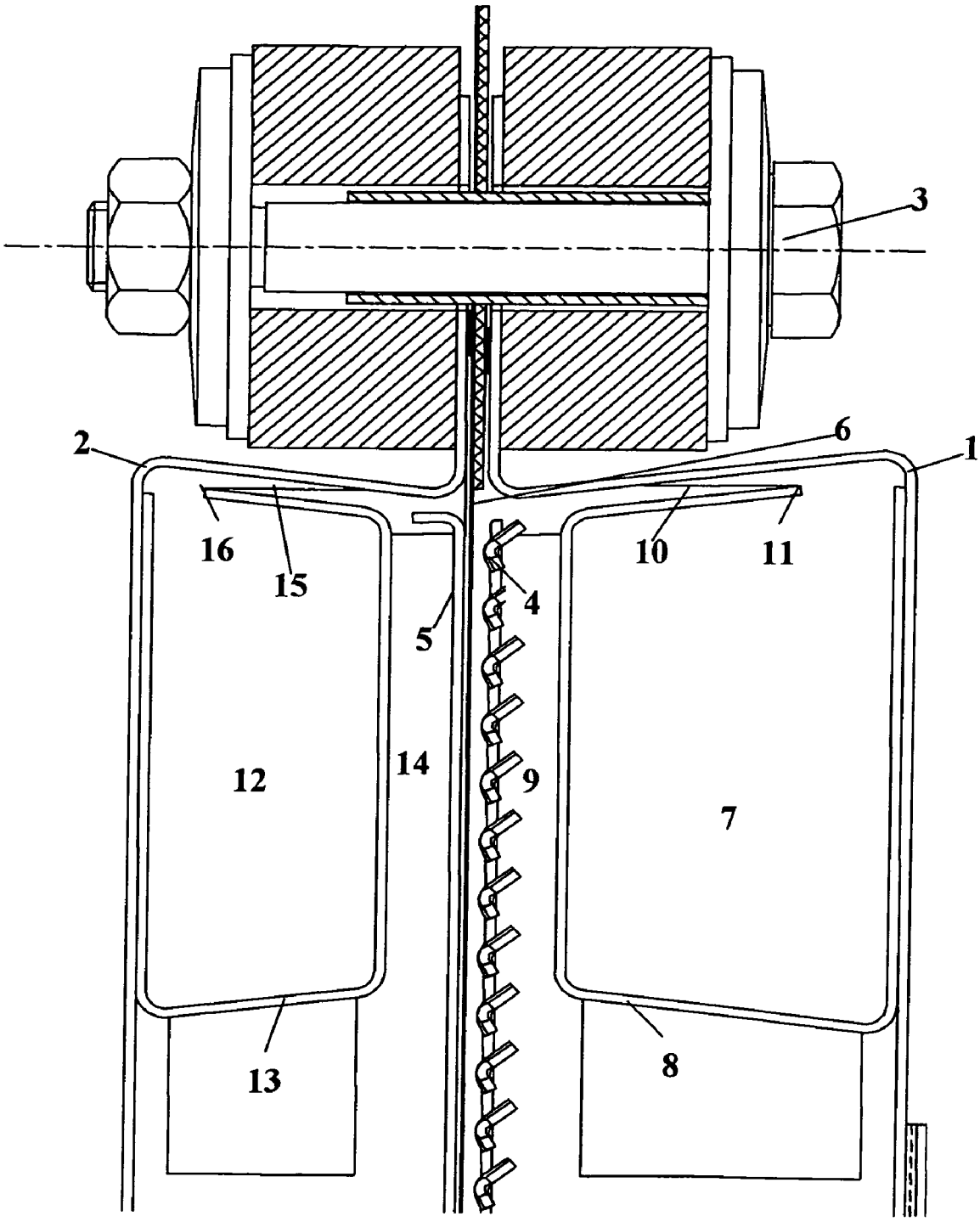
FIG. 1 shows a cross-sectional view of the upper part of an electrolytic cell provided with the troughs described in this invention and arranged on the anodic and cathodic sides.

The two half-shells of the electrolytic cell are formed by anode rear wall 1 and cathode rear wall 2 and firmly clamped by means of bolted connection 3. The anodic electrode 4 of louver-type design and the cathodic electrode 5 are arranged approximately in the centre of the electrolyser by means of support and fixing elements not shown in the FIGURE, the electrolytic membrane 6 being located between electrodes 4 and 5.

The anode side shows the trough 7 designed as a folded sheet 8. The chlorine gas that forms at the louver-type anodic electrode 4 and the electrolytic liquid simultaneously enter as a foam the interspace 9 located between sheet 8 delimiting trough 7 and electrode 4. The major part of the foam bubbles collapses underneath trough 7 so that they enter pre-separated into trough 7 via interspace 9 and gap 10.

In the event of a shutdown, the amount of liquid admitted to the cell is such that its level reaches the upper end 11 of gap 10. This method permits to completely wet membrane 6 on the anode side, which reduces the quantity of hydrogen diffusing from the cathode to anode side.

The cathode side shows trough 12 designed as bent sheet 13. The hydrogen gas formed at the flat cathodic electrode 5 and the electrolytic liquid simultaneously enter the interspace 14 located between sheet 13 delimiting trough 12 and electrode 5 as foam bubbles. The major part of the foam bubbles burst underneath trough 12 so that they are pre-separated and enter trough 12 via interspace 14 and gap 15.

In the event of a shutdown, the amount of liquid admitted to the cell is such that its level reaches upper end 16 of gap 15. This method permits wetting of the complete membrane 6 on the cathodic side, which prevents hydrogen diffusion from the cathodic to the anodic side.

The invention claimed is:

1. An electrolytic cell for halogen gas production comprising:

a housing of two half-shells made of electrically conductive material;

anodic and cathodic electrodes (4, 5) with an electrolytic membrane (6) arranged therebetween;

at least one of said half-shells being provided with built-in components permitting a defined increase in the liquid level over the top edge of said electrolytic membrane (6), said built-in components forming an internal trough (7) having one major surface parallel to the electrolytic membrane (6) and spaced therefrom by a first interspace (9, 14);

a second interspace (10, 15) inclined both outwards and upwards with respect to the horizontal plane as seen from said electrolytic membrane (6) being established between said trough (7) and the upper side of said at least one half-shell, said trough (7) having at least one opening communicating with said second interspace (10, 15) and at least one outlet and the highest point of said second interspace (10, 15) is located above the upper side of said electrolytic chamber (6).

2. The cell of claim 1 wherein said trough (7) is arranged horizontally.

3. The cell of claim 1 wherein said second interspace (10, 15) is implemented as a 2 to 3 mm wide gap.

4. The cell of claim 1 wherein said second interspace (10, 15) is implemented as a variable gap provided with straight, corrugated or arched delimiting surfaces.

5. The cell of claim 1 wherein said second interspace (10, 15) is equipped with a perforated plate arranged in parallel to said electrolytic membrane (6) or slightly inclined therefrom.

6. The cell of claim 1 wherein a multiplicity of beads, webs, nipples or other spacers are installed in said second interspace (10, 15).

7. The cell of claim 1 wherein said built-in components forming the trough (7) are at least partly coated to ensure adequate corrosion protection.

8. Electrolytic device for halogen gas production from aqueous alkali halide solution comprising plate-type electrolytic cell stacked and arranged side by side, at least one of said electrolytic cells being a cell of claim 1.

9. An electrolytic cell for halogen gas production comprising:

a housing of two half-shells made of electrically conductive material;

anodic and cathodic electrodes (4, 5) with an electrolytic membrane (6) arranged therebetween;

at least one of said half-shells being provided with built-in components permitting a defined increase in the liquid level over the top edge of said electrolytic membrane (6), said built-in components forming an internal trough (7) having one major surface parallel to the electrolytic membrane (6) and spaced therefrom by a first interspace (9, 14);

a second interspace (10, 15) inclined both outwards and upwards with respect to the horizontal plane as seen from said electrolytic membrane (6) being established between said trough (7) and the upper side of said at least one half-shell, said trough (7) having at least one opening communicating with said second interspace (10, 15) and at least one outlet, the said second interspace (10, 15) is equipped with duct bundles, the axes of said ducts lying in the plane of said second interspace (10, 15).

10. The cell of claim 9 wherein said ducts are circular or honeycomb-structured.

* * * * *